US006012440A

United States Patent [19]

Grindle

[11] Patent Number: 6,012,440

[45] **Date of Patent: *Jan. 11, 2000**

[54] BRACE FOR AN ARCHERY BOW

[76] Inventor: Joseph Gary Grindle, 234 Mimosa La., Stockbridge, Ga. 30281

[ * ] Notice: This patent is subject to a terminal disclaimer.

[21] Appl. No.: 08/452,657

[22] Filed: May 25, 1995

[51] Int. Cl.[7] ..... F41B 5/18

[52] U.S. Cl. ..... 124/86; 124/35.2

[58] Field of Search ..... 124/23.1, 25.6, 124/86, 88, 35.2

[56] References Cited

U.S. PATENT DOCUMENTS

| | | | |
|---|---|---|---|
| 2,664,078 | 12/1953 | Irwin . | |
| 2,815,016 | 12/1957 | Kellogg . | |
| 2,982,279 | 5/1961 | Pursley . | |
| 3,446,200 | 5/1969 | Gross . | |
| 3,512,512 | 5/1970 | Wentz . | |
| 3,563,592 | 2/1971 | Preston | 292/263 |
| 3,750,641 | 8/1973 | Ramsey . | |
| 3,794,012 | 2/1974 | Ramsey . | |
| 3,895,621 | 7/1975 | Kellogg . | |
| 4,041,925 | 8/1977 | Barrick . | |
| 4,066,051 | 1/1978 | Alban | 124/86 |
| 4,466,418 | 8/1984 | Jones . | |
| 4,471,747 | 9/1984 | Nishioka . | |
| 4,603,676 | 8/1986 | Luoma | 124/25 |
| 4,615,326 | 10/1986 | Rathbun | 124/88 |
| 4,672,945 | 6/1987 | Carlton . | |
| 4,886,039 | 12/1989 | Wagner . | |
| 4,919,107 | 4/1990 | Bunts . | |
| 5,000,154 | 3/1991 | Slayton | 124/23.1 |
| 5,002,035 | 3/1991 | Brooks | 124/23.1 |
| 5,065,730 | 11/1991 | Kluver | 124/35.2 |
| 5,092,308 | 3/1992 | Sheffield | 124/35.2 |
| 5,156,138 | 10/1992 | Grover | 124/35.2 |
| 5,390,654 | 2/1995 | Perkins | 124/88 X |
| 5,465,705 | 11/1995 | Baeseman | 124/88 |

*Primary Examiner*—Eric K. Nicholson
*Assistant Examiner*—John A. Ricci

[57] ABSTRACT

A brace for an archery bow is provided which safely keeps the bow in a cocked position for an extended period of time without fatigue. The brace has a front leg, a middle leg, a rear leg. In the cocked position, the brace legs are selectively prevented from pivoting longitudinally by first and second pivot stops. The coordination of the relative angles between the front, middle and rear brace legs provides the brace with stability to withstand the tension of shooting an arrow.

21 Claims, 4 Drawing Sheets

BRACE FOR AN ARCHERY BOW

BACKGROUND OF THE INVENTION

This invention relates to the sport of archery, and especially bow hunting. Bow hunters must stalk or wait for game to come within range often for a considerable period of time before an opportunity to shoot arises. Due to the time and noise required to properly nock, draw and fire an arrow, the game may be alerted and attempt to flee. Hunters may try to maintain their bow in a partially cocked position, however, the tension required by modern compound bows results in muscle fatigue and a loss of shooting accuracy.

Available bow cocking mechanisms have varied hinged attachments which partially obscure the archer's view of the target. Such existing devices only partially cock the bow, requiring the hunter to manually draw, aim and maintain an arrow in the fully cocked position until release. The existing devices are cumbersome to set and do not allow a bow hunter to react quickly enough. Existing hinged devices which extend perpendicularly in linear alignment from the bow shaft to the bow string are unstable and may be dangerous to use due to the potential for misfiring.

SUMMARY OF THE INVENTION

The present invention provides a brace for an archery bow to hold the bow string and nocked arrow in a cocked position. The invention permits the archer to maintain the bow in the cocked position for any desired period of time. The invention provides a brace which is stabilized by opposing angular forces created throughout the various elements thereof. The brace of the present invention has front, middle and rear brace legs.

DETAILED DESCRIPTION OF THE INVENTION

Figure 1:
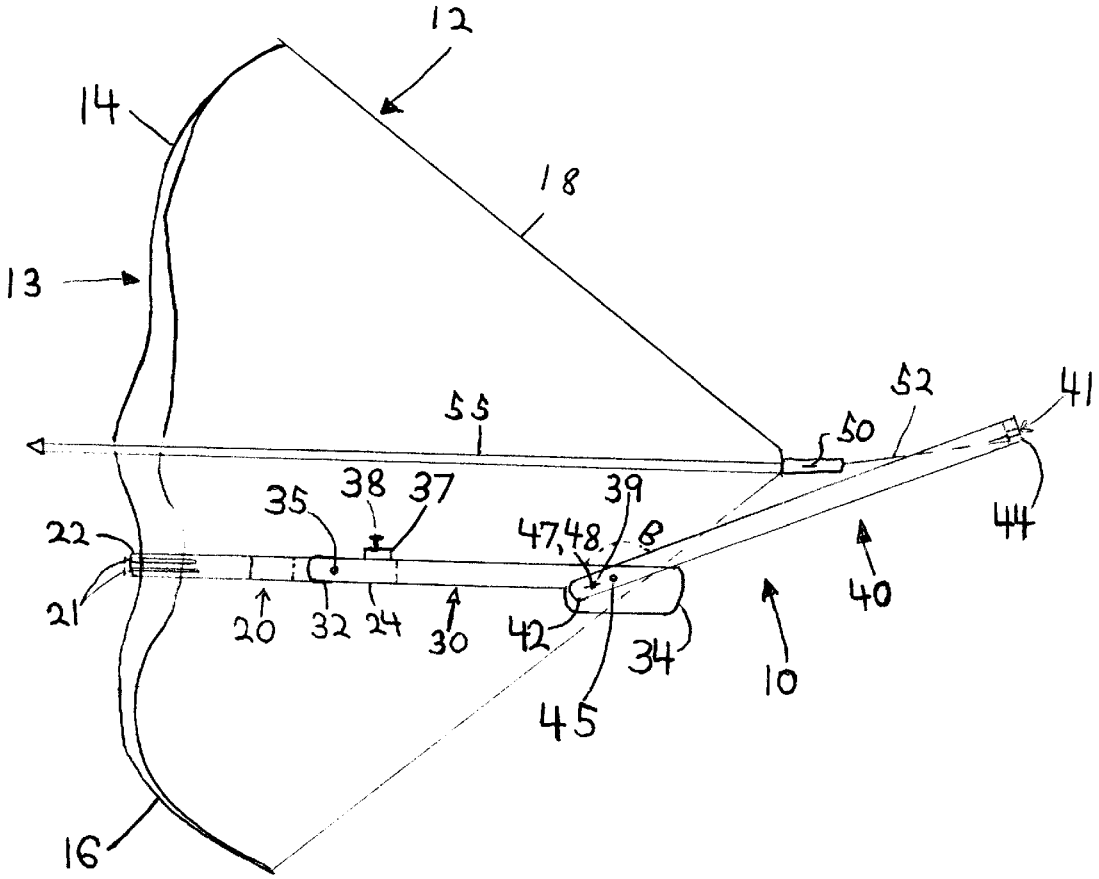
FIG. 1 is a side view of the brace of the present invention mounted in a compound bow in the cocked position.
Figure 2:
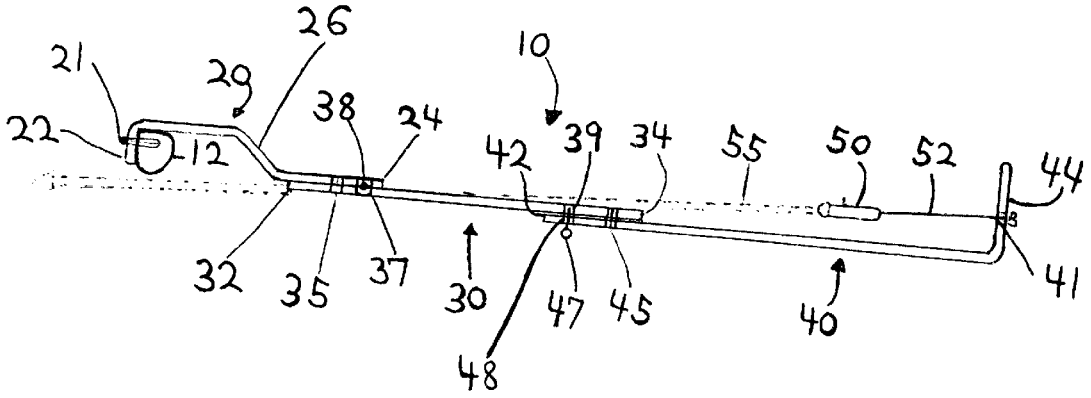
FIG. 2 is a top view of the brace of the present invention mounted in a compound bow in the cocked position with the arrow shown in dashed lines for clarity of the brace.

Referring to FIGS. 1 and 2, a brace 10 for an archery bow 12 is provided by the invention. An archery bow 12 commonly has a bow frame 13 with an upper limb 14 and a lower limb 16, and a bow string 18 disposed therebetween. Modern compound bows commonly used for hunting may be equipped with pulleys or other features, however, the present invention is adapted for use with all bow models. The brace 10 generally has a front leg 20, a middle leg 30 and a rear leg 40. The legs 20, 30, 40 of the brace 10 can be constructed of hard durable material such as metal, wood or plastic. Preferably, the legs 20, 30, 40 are constructed of a strong, light weight metal alloy, such as aluminum.

The brace 10 has a front brace leg 20 with a first end 22 and a second end 24. The first end 22 is adapted to be removably attached to the bow frame 12 such that the front brace leg 20 extends perpendicularly from the bow frame 12 towards the bow string 18. The brace 10 can be mounted on the bow 12 by different fastening devices, such as by a pair of bolts 21 inserted through the first end 22 of the front leg brace 20 and through the bow frame 13. The front brace leg 20 of the preferred embodiment has a generally C-shaped first end 22 for removable attachment to the front of the bow frame 13, which has holes therethrough to receive the two bolts 21. As seen in FIG. 2, the front brace leg 20 has a horizontally angled portion 26 to provide an additional stabilizing shape to the brace 10. Attachment of the brace 10 is preferably made at a point just below the middle, or belly, of the bow frame 13.

The middle brace leg 30 also has a first end 32 and a second end 34. The first end 32 of the middle brace leg 30 is pivotally attached adjacent to the second end 24 of the front brace leg 20. This attachment is adapted for longitudinal rotation. Pivotal attachment may be made by a variety of hinging systems. An axial pin 35 may be inserted through the juxtaposed ends of the front 20 and middle 30 legs, as shown.

A first pivot stop means for selectively preventing the front brace leg 20 from pivoting at a predetermined point relative to the middle brace leg 30 is also provided. In one preferred embodiment, the first pivot stop means is positioned proximal to the attachment of said front brace leg 20 and said middle brace leg 30. The first pivot stop means is shown as a flange 37 extending from the second end 24 of the front brace leg 20. The flange 37 thereby prevents the front brace leg 20 from pivoting at a predetermined point relative to said middle brace leg 30.

Figure 3:
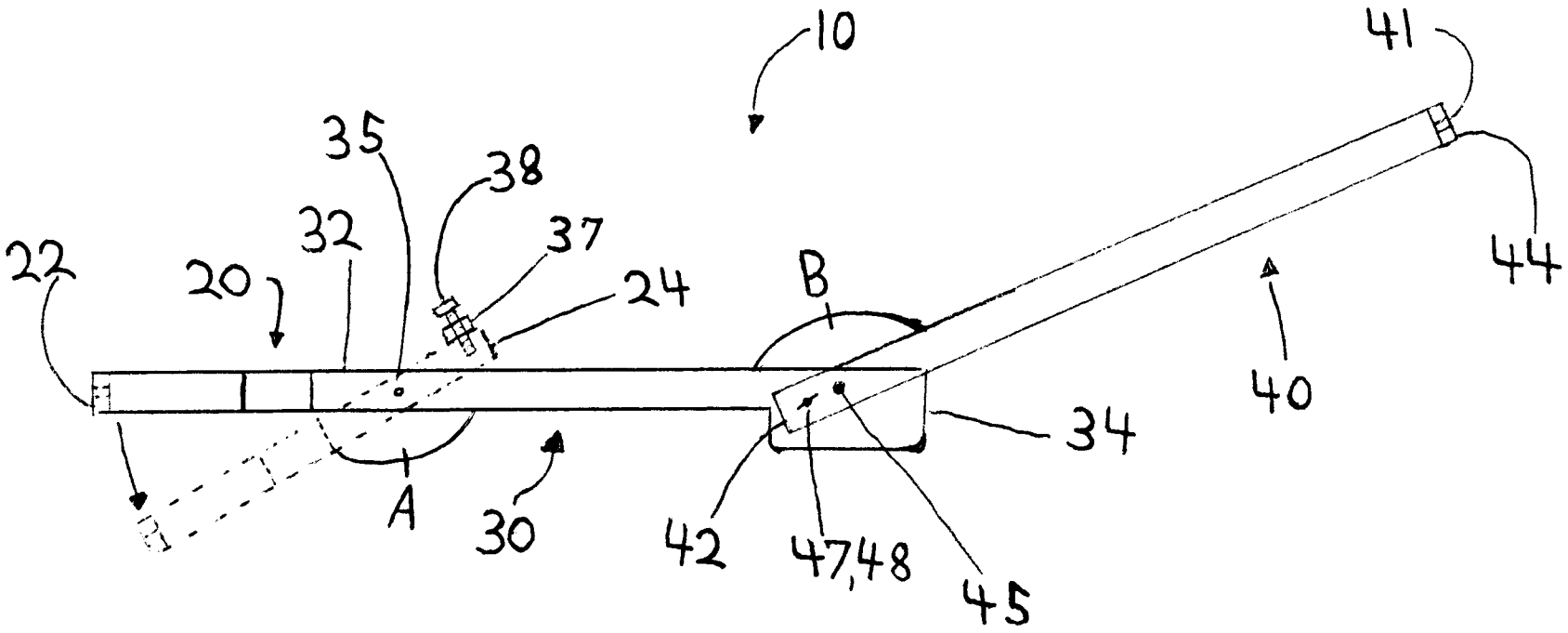
FIG. 3 is a side view of the brace of the present invention showing an alternate angular adjustment of the first brace leg in dashed lines.

In preferred embodiments, the flange 37 can be further equipped with a set screw 38 for optimizing the predetermined point at which the front brace leg 20 is prevented from pivoting relative to said middle brace leg 30. As shown in FIG. 3, the set screw 38 can be rotated to extend downward towards the middle brace leg 30 such that a downward angle A of 180 degrees or less is formed by the longitudinal axes of the middle 30 and front 20 brace legs relative to each other. The set screw 38 permits an adjustable range of angles for tuning the brace 10 to a variety of bow types and archer preferences.

A rear brace leg 40 is also provided, which has a first end 42 and a second end 44. The first end 42 is pivotally attached adjacent to the second end 34 of the middle brace leg 30 and is adapted for longitudinal rotation. Again, pivotal attachment may be made by a variety of hinging systems, such as by an axial pin 45 inserted through the juxtaposed ends of the middle 30 and rear 40 legs, as shown.

A second pivot stop means for selectively locking the middle brace leg 30 relative to the rear brace leg 40 at an upward angle B of less than 180 degrees is provided. Preferably, this angle B of less than 180 degrees is in the upward direction, however, the opposite configuration, including that corresponding to the normally downward angle A of the first pivot stop means, is also contemplated by the invention. The angle B between the middle 30 and rear 40 brace legs is preferably between about 120 degrees and 175 degrees, and more preferably about 160 degrees. In the cocked position, the brace legs 30, 40, 50 are selectively prevented from pivoting longitudinally by the first and second pivot stop means.

As shown, the second pivot stop means is located proximal to the attachment of said middle brace leg 30 and said rear brace leg 40. The second pivot stop means shown has a spring loaded pin 47 on the first end of said rear brace leg. The pin 47 is in selective communication with a corresponding pin receptacle 48 on the second end 34 of said middle brace leg 30. As the brace is extended into the fully cocked position, the pin receptacle 39 is exposed to the spring loaded pin 47, which enters the receptacle 39 and locks the middle 30 and rear 40 brace legs in a relative angle B of less than 180 degrees.

Figure 4:
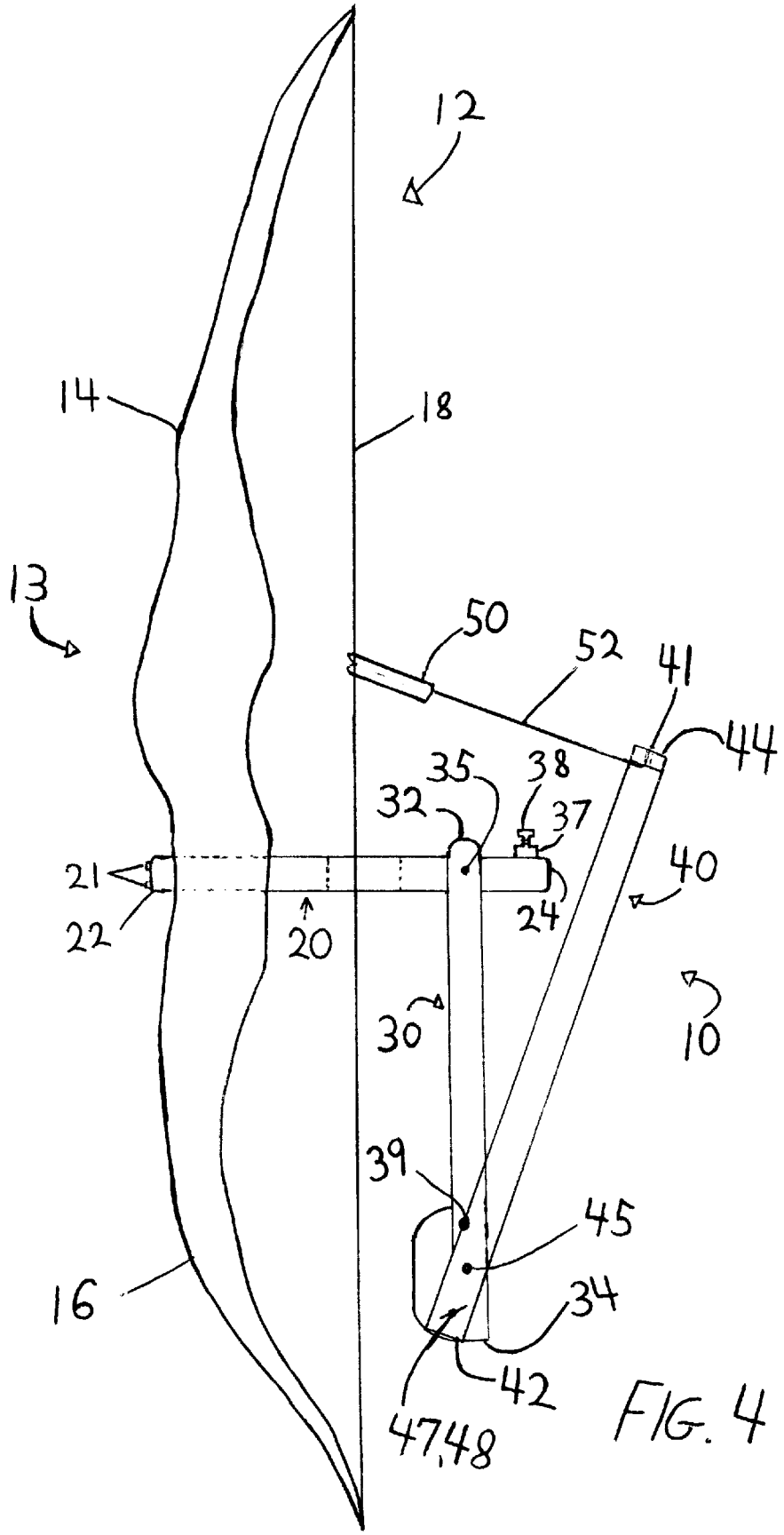
FIG. 4 is a side view of the brace of the present invention mounted in a compound bow in the un-cocked position.

The pin 47 has a ring 48 attached to one end thereof to facilitate removing the pin 47 from communication with the receptacle 39. As shown in FIG. 4, The locking mechanism on the second pivot stop means can be released by pulling the ring 48 and pin 47 slightly outward against the spring load to disengage the rear 40 and middle 30 legs for folding the brace 10 in the un-cocked position. The bow 12 and brace 10 may be easily transported and stored as a single unit in the un-cocked position.

The brace 10 of the present invention carries tension in both horizontal and vertical dimensions. Horizontal forces are carried from side to side between the bow 12 and bow string 18 as usual. The formation of the angles A,B defined by the first and second pivot stop means, however, provides the additional stabilizing vertical forces. The present invention provides a vector of force from the bow string 18 downward through the rear leg brace 40 to the second pivot stop. This force is countered by the upward force exerted from the lower portion of the bow frame 16 against the first end 22 of the front brace leg 20 to the first pivot stop. Thus, these vertically opposing angles of force through the front 20, middle 30 and rear 40 legs allow an increased amount tension to be maintained versus other linearally-stabilized bow cocking devices. The present invention utilizes the principle of leverage throughout the front 20, middle 30 and rear 40 legs to transfer and balance the forces required to maintain the bow 12 in the cocked position. This additional force load capacity is also necessary for maintaining the fully cocked position of many modern compound bows.

As mentioned previously, in one preferred embodiment the angle A of the front brace leg relative to the middle brace leg can be adjusted using the set screw 38 on the first pivot stop means, or flange 37. Thus, these vertically opposing angles of force through the front 20, middle 30 and rear 40 legs allow a variable amount of tension.

A means for attaching a bow string catch 50 adjacent to the second end 44 of the rear brace leg 40 is also provided as a hole or notch 41. The bow string catch 50 permits selective release of the bow string 18 by the archer. The bow string catch 50 is a commercially available, manually releasable bow string catch connected proximal to the second end 44 of the rear brace leg 40 by a cord 52. The length of the cord 52 will also affect the amount of tension carried by the brace 10, and can be adjusted for the particulars of any situation. The bow string catch 50 generally holds the bow string 18 and nocked arrow 55 until a mechanical switch is moved to release the catch 50. The invention contemplates that a variety of known bow string catches may be adapted for use with the present invention.

The preceding embodiments are intended to illustrate, but not limit, the invention. While they are typical of those that might be used, other adaptations known to those skilled in the art can alternatively be employed.

What is claimed is:

1. A brace for an archery bow having a bow frame with an upper limb and a lower limb, and a bow string disposed therebetween, comprising:

a. a front brace leg having a first end and a second end, wherein the first end is adapted to be removably attached to the bow frame such that the front brace leg extends perpendicularly from the bow frame towards the bow string;

b. a middle brace leg having a first end pivotally attached adjacent to the second end of said front brace leg adapted for longitudinal rotation, and a second end;

c. a first pivot stop means for selectively preventing the front brace leg from pivoting at a predetermined point relative to the middle brace leg;

d. a rear brace leg having a first end pivotally attached adjacent to the second end of said middle brace leg adapted for longitudinal rotation, and a second end;

e. a second pivot stop means for selectively locking said middle brace leg relative to said rear brace leg at an angle of less than 180 degrees; and f. a means for attaching a bow string catch adjacent to the second end of said rear brace leg to permit selective release of the bow string.

2. The brace of claim 1, wherein said first pivot stop means is positioned proximal to the attachment of said front brace leg and said middle brace leg.

3. The brace of claim 2, wherein said first pivot stop means comprises a flange extending from the second end of said front brace leg, wherein said flange prevents the front brace leg from pivoting at the predetermined point relative to said middle brace leg.

4. The brace of claim 3, wherein said flange further comprises a set screw for varying the predetermined point at which the front brace leg is prevented from pivoting relative to said middle brace leg.

5. The brace of claim 1, wherein said second pivot stop means is located proximal to the attachment of said middle brace leg and said rear brace leg.

6. The brace of claim 5, wherein said second pivot stop means comprises a spring loaded pin on the first end of said rear brace leg, said pin being in selective communication with a corresponding pin receptacle on the second end of said middle brace leg.

7. The brace of claim 1, wherein said second pivot stop means creates an angle of between 120 degrees and 175 degrees between said middle brace leg and said rear brace leg.

8. A modified archery bow comprising:

a. a bow frame comprising an upper limb and a lower limb;

b. a bow string disposed between said upper limb and said lower limb;

c. a bow string catch selectively attached to said bowstring;

d. a front brace leg having a first end and a second end, wherein the first end is adapted to be removably attached to said bow frame such that the front brace leg extends perpendicularly from said bow frame towards said bow string;

e. a middle brace leg having a first end pivotally attached adjacent to the second end of said front brace leg adapted for longitudinal rotation, and a second end;

f. a first pivot stop means for selectively preventing the front brace leg from pivoting at a predetermined point relative to the middle brace leg;

g. a rear brace leg having a first end pivotally attached adjacent to the second end of said middle brace leg adapted for longitudinal rotation, and a second end;

h. a second pivot stop means for selectively locking said middle brace leg relative to said rear brace leg at an angle of less than 180 degrees; and i. a means for attaching the bow string catch adjacent to the second end of said rear brace leg to permit selective release of the bow string.

9. The modified archery bow of claim 8, wherein said first pivot stop means is positioned proximal to the attachment of said front brace leg and said middle brace leg.

10. The modified archery bow of claim 8, wherein said first pivot stop means comprises a flange extending from the second end of said front brace leg, wherein said flange prevents the front brace leg from pivoting at the predetermined point relative to said middle brace leg.

11. The modified archery bow of claim 10, wherein said flange further comprises a set screw for varying the predetermined point at which the front brace leg is prevented from pivoting relative to said middle brace leg.

12. The modified archery bow of claim 8, wherein said second pivot stop means is located proximal to the attachment of said middle brace leg and said rear brace leg.

13. The modified archery bow of claim 12, wherein said second pivot stop means comprises a spring loaded pin on the first end of said rear brace leg, said pin being in selective communication with a corresponding pin receptacle on the second end of said middle brace leg.

14. The modified archery bow of claim 8, wherein said second pivot stop means creates an angle of between 120 degrees and 175 degrees between said middle brace leg and said rear brace leg.

15. An improved archery bow having a bow frame with an upper limb and a lower limb, and a bow string disposed therebetween, the improvement comprising:

a. a front brace leg having a first end and a second end, wherein the first end is adapted to be removably attached to the bow frame such that the front brace leg extends perpendicularly from the bow frame towards the bow string;

b. a middle brace leg having a first end pivotally attached adjacent to the second end of said front brace leg adapted for longitudinal rotation, and a second end;

c. a first pivot stop means for selectively preventing the front brace leg from pivoting at a predetermined point relative to the middle brace leg;

d. a rear brace leg having a first end pivotally attached adjacent to the second end of said middle brace leg adapted for longitudinal rotation, and a second end;

e. a second pivot stop means for selectively locking said middle brace leg relative to said rear brace leg at an angle of less than 180 degrees; and f. a bow string catch attached adjacent to the second end of said rear brace leg to permit selective release of the bow string.

16. The improved archery bow of claim 15, wherein said first pivot stop means is positioned proximal to the attachment of said front brace leg and said middle brace leg.

17. The improved archery bow of claim 15, wherein said first pivot stop means comprises a flange extending from the second end of said front brace leg, wherein said flange prevents the front brace leg from pivoting at the predetermined point relative to said middle brace leg.

18. The improved archery bow of claim 17, wherein said flange further comprises a set screw for varying the predetermined point at which the front brace leg is prevented from pivoting relative to said middle brace leg.

19. The improved archery bow of claim 15, wherein said second pivot stop means is located proximal to the attachment of said middle brace leg and said rear brace leg.

20. The improved archery bow of claim 19, wherein said second pivot stop means comprises a spring loaded pin on the first end of said rear brace leg, said pin being in selective communication with a corresponding pin receptacle on the second end of said middle brace leg.

21. The improved archery bow of claim 15, wherein said second pivot stop means creates an angle of between 120 degrees and 175 degrees between said middle brace leg and said rear brace leg.

* * * * *